United States Patent [19]

Bates et al.

[11] Patent Number: 4,534,265

[45] Date of Patent: Aug. 13, 1985

[54] SABOT DIVERTER

[75] Inventors: Jack Bates, Ridgecrest; Arthur E. Clayson, Inyokern, both of Calif.

[73] Assignee: The United States of America as represented by the Secretary of the Navy, Washington, D.C.

[21] Appl. No.: 537,212

[22] Filed: Sep. 29, 1983

[51] Int. Cl.[3] ..... F41F 17/12

[52] U.S. Cl. ..... 89/14.6; 89/37.16

[58] Field of Search ..... 89/14.6, 37.5 R, 37.5 E

[56] References Cited

U.S. PATENT DOCUMENTS

| | | | |
|---|---|---|---|
| 3,520,226 | 7/1970 | Meadows et al. | 89/14.6 |
| 3,533,325 | 10/1970 | Barr | 89/14.6 |
| 3,670,622 | 6/1972 | Bryant et al. | 89/37.5 R |
| 3,898,910 | 8/1975 | Groff | 89/37.5 R |
| 4,022,103 | 5/1977 | Schmidt | 81/14.6 |

*Primary Examiner*—Stephen C. Bentley

*Attorney, Agent, or Firm*—Robert F. Beers; W. Thom Skeer; Thomas W. Hennen

[57] ABSTRACT

A sabot fragment diverter deflects selected sabot fragments discarded by sabot type ammunition in a directionally controlled manner to prevent direct fragment impact with the firing platform or impact of a deflected fragment with the projectile from which it is discarded. A fragment diverter cone which includes a deflecting surface, a fragment cutter and a barrier dam is connected to the muzzle end of a gun system by an extender cage and a mounting section.

6 Claims, 10 Drawing Figures

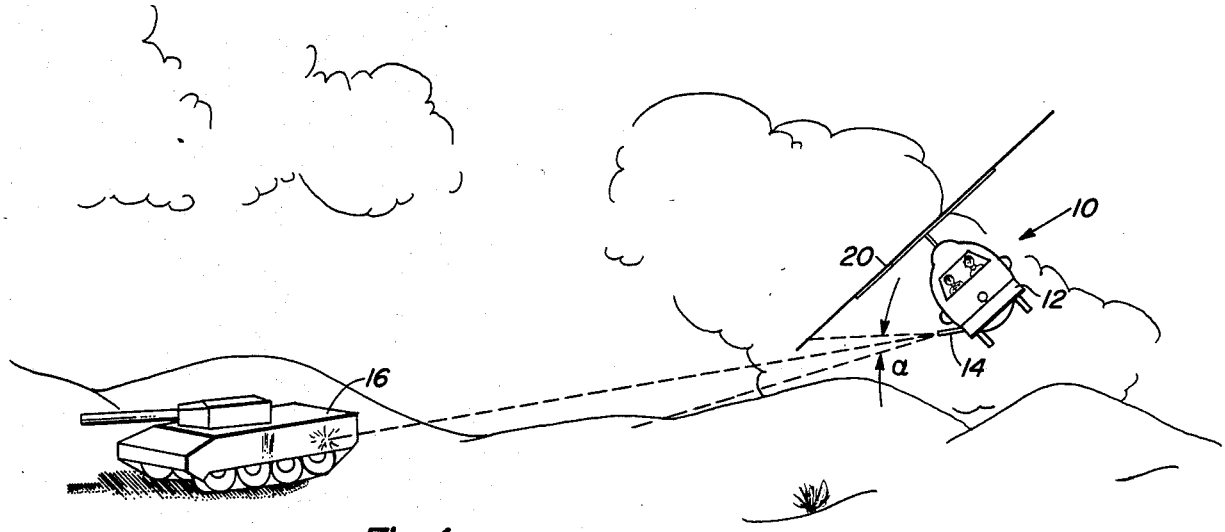
Fig. 1
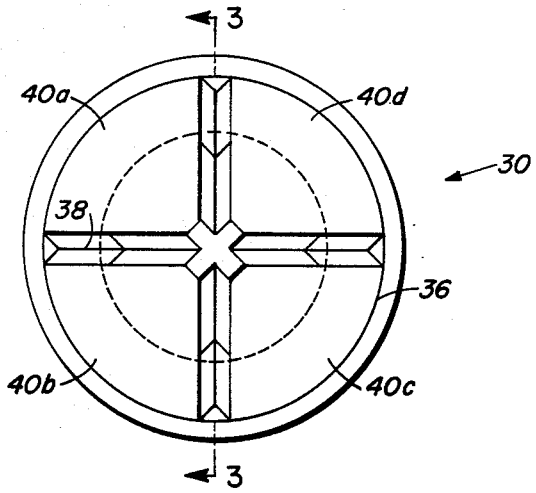
Fig. 2
Fig. 3
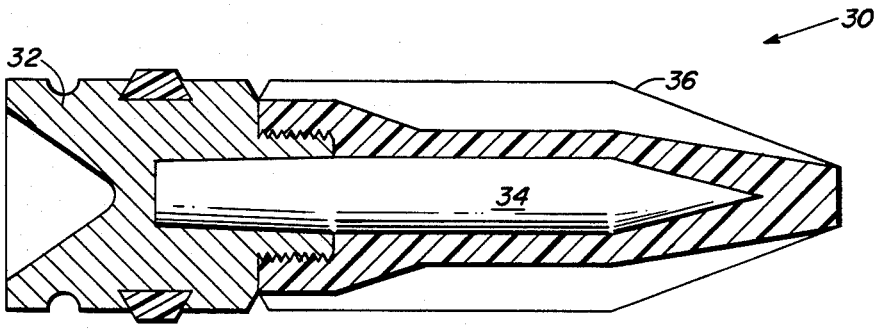

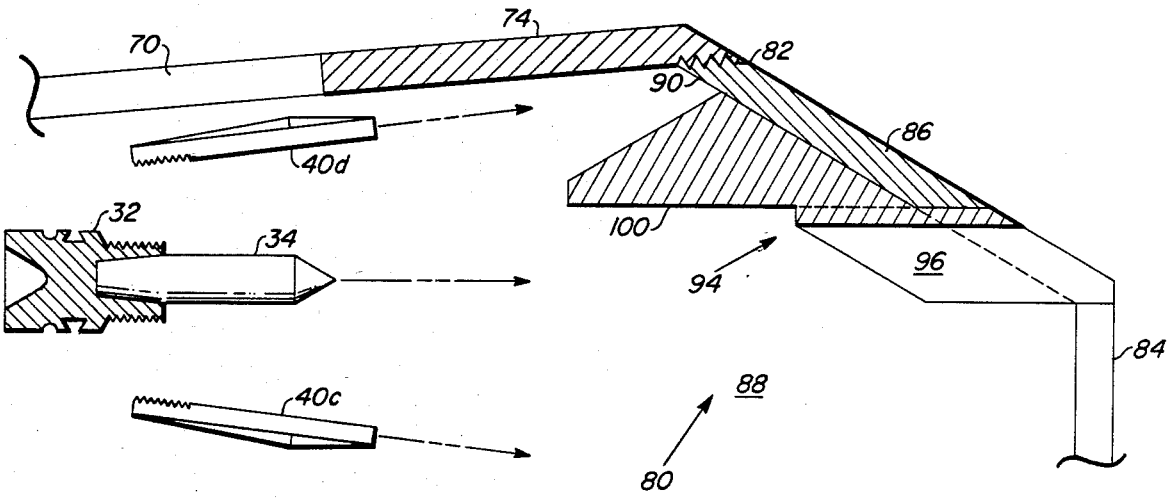
Fig. 8
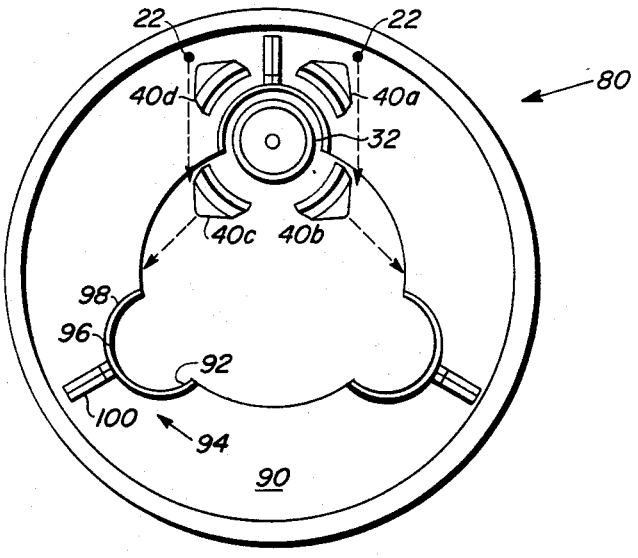
Fig. 9
Fig. 10
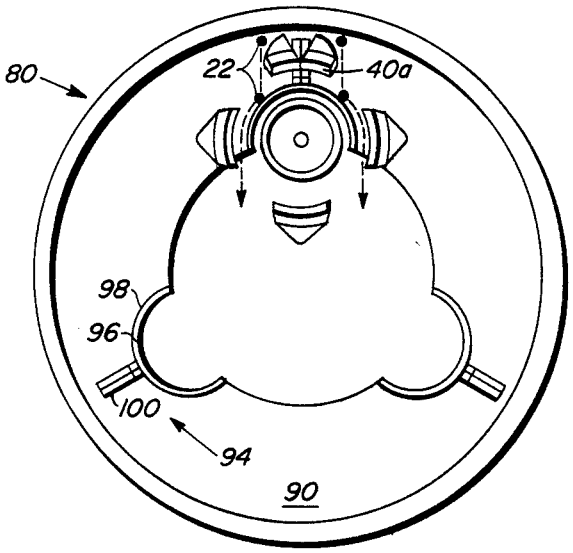

SABOT DIVERTER

BACKGROUND OF THE INVENTION

1. Field of the Invention

This invention relates generally to apparatus for deflecting, in a controlled manner, the fragments which result from use of discarding sabot ammunition and more specifically to a sabot fragment diverter utilized in conjunction with a helicopter mounted tracking gun system to deflect discarded sabot fragments away from the helicopter's rotary wing.

2. Description of the Prior Art

Heavy metal subcaliber penetrators have proven superior over full caliber hardened steel penetrators in armor piercing projectile applications. Many projectiles which incorporate heavy metal penetrators are of the discarding sabot type. The superior armor penetration capabilities of this type of ammunition makes it extremely attractive for use with helicopter mounted tracking gun systems. However, the use of discarding sabot type ammunition does pose the increased possibility of foreign object damage (FOD) to the helicopter. The problem identified as most critical with respect to certain helicopter/gun system configurations concerns the direct impact of high speed sabot petals or fragments with the underside of the helicopter's rotary wing. This problem occurs when the gun tracking system causes the gun barrels to move in relationship to the wing such that the rotor tip enters the area in which discarded sabot petals can be expected to be encountered. Sabots and the fragments which result from their use are typically fabricated from a light, brittle material such as fiberglass reinforced plastic which can, in most applications, be ignored. In helicopter applications however, the possibility of self-inflicted damage to the helicopter's rotary wing exists if direct impact of sabot fragments traveling at several thousand feet per second is allowed to occur.

To prevent rotor damage a lock-out device is presently used to limit the tracking angle and elevation in certain helicopter mounted gun systems. The use of the lock-out device to prevent the tracking gun system from training to full design limits is to be avoided if possible for several reasons. First, limiting the angle through which a gun system can be trained where the gun system is utilized to engage hostile armored vehicles likely to return fire when fired upon can be fatal to the platform carrying the gun system. A difference of even a few degrees of train or elevation may prove to be the difference between destroying or failing to destroy hostile armor. Should system lock-out occur during an engagement the attacking platform may itself become the victim for failing to keep its target engaged and in a defensive posture or, alternatively, the target may escape to cover during the lock-out period.

If sabot fragments resulting from the use of discarding sabot armor piercing projectiles were to be diverted to the extent that their flight path would not impact the firing platform at any degree of train or elevation within design limits no lock-out device would be necessary for this purpose. Use of a tracking gun system to full design specifications provides the platform carrying that gun system a greater probability of success against hostile targets while increasing the degree of survivability of that platform. The sabot diverter of the present invention accomplishes the deflection of sabot fragments such that no fragment from discarding sabot ammunition can directly impact the firing platform even when the gun system is used at the extremes of its design limits. Further, sabot petals and fragments are diverted so as not to impact the projectile from which discarded. The use of the sabot diverter of the present invention in a helicopter mounted tracking gun system allows the system to be utilized to design limits irrespective of helicopter attitude and, as a result, the effectiveness and survivability of the helicopter is enhanced.

SUMMARY OF THE INVENTION

The present invention is a sabot diverter for attachment to the muzzle end of one or more gun barrels of a tracking gun system. Its purpose is to deflect sabot fragments out of a trajectory which would result in their impact with the firing platform. The sabot diverter is further designed to ensure that no deflected fragment will impact the armor piercing metal penetrator from which it separates upon exiting the gun barrel so as to alter the penetrator's flight path. As a discarding sabot projectile exits a gun barrel the sabot disintegrates into several petals or fragments. The trajectory of sabot fragments tends away from the axis of the gun barrel at a small angle. When attached to a gun barrel, the diverter of the present invention acts to ensure that sabot petals whose trajectory might lead to direct impact with the firing platform are intercepted and deflected into a trajectory not allowing for the possibility of direct platform impact. Sabot fragments, whose firing trajectory will not result in direct impact with the firing platform, are unaffected by the sabot diverter. The essence of the present device is found in a cutter-dam arrangement which, in conjunction with the inner surface of a diverter section presents physical barriers of controlled angle and geometry to selected sabot fragments having potentially damaging trajectories. Impact of a sabot fragment with any of the barriers presented by the sabot diverter of the present invention will result in that fragment's trajectory being altered one or more times such that no possibility exists that the deflected fragment will directly impact the firing platform.

OBJECTS OF THE INVENTION

An object of the present invention is to provide a sabot diverter which operates to alter the trajectory of selected sabot fragments.

A further object of the present invention is to provide a sabot diverter which alters the trajectory of the selected sabot fragments in a controlled manner to ensure those fragments do not enter the line of fire of the gun barrel from which they issue.

Another object of the present invention is to provide a sabot diverter which, when utilized in conjunction with a helicopter-borne tracking gun system will allow the gun system to operate to full design limits utilizing discarding sabot ammunition without the possibility of direct sabot fragment impact with the helicopter rotor.

Still a further object of the present invention is to provide a sabot diverter for a rotary wing aircraft which is easily retrofitted to existing gun systems and need not be removed to accommodate non-sabot type projectiles.

Other objects and novel features of the present invention will become apparent from the following detailed description of the invention when considered in conjunction with the accompanying drawings.

BRIEF DESCRIPTION OF THE DRAWINGS

FIG. 1 is pictorial view of the engagement of a helicopter gun platform with an armored vehicle.

FIG. 2 is a forward end view of a typical discarding sabot projectile.

FIG. 3 is a cross-sectional view taken along lines 3—3 of the discarding sabot projectile of FIG. 2.

FIG. 8 is an enlarged partial cross section of the sabot diverter of FIG. 5 more clearly illustrating the cutter and diverter apparatus.

FIG. 9 is a cross-sectional view taken along lines 9—9 of FIG. 5 demonstrating the arrangement of the cutter and diverter apparatus and illustrating one possible interaction of sabot fragments with the sabot diverter.

FIG. 10 is a partial cross-sectional figure according to FIG. 9 demonstrating a different interaction of sabot fragments with the sabot diverter in which the cutter and diverter apparatus comes into play.

DESCRIPTION OF THE PREFERRED EMBODIMENT

Figure 4:
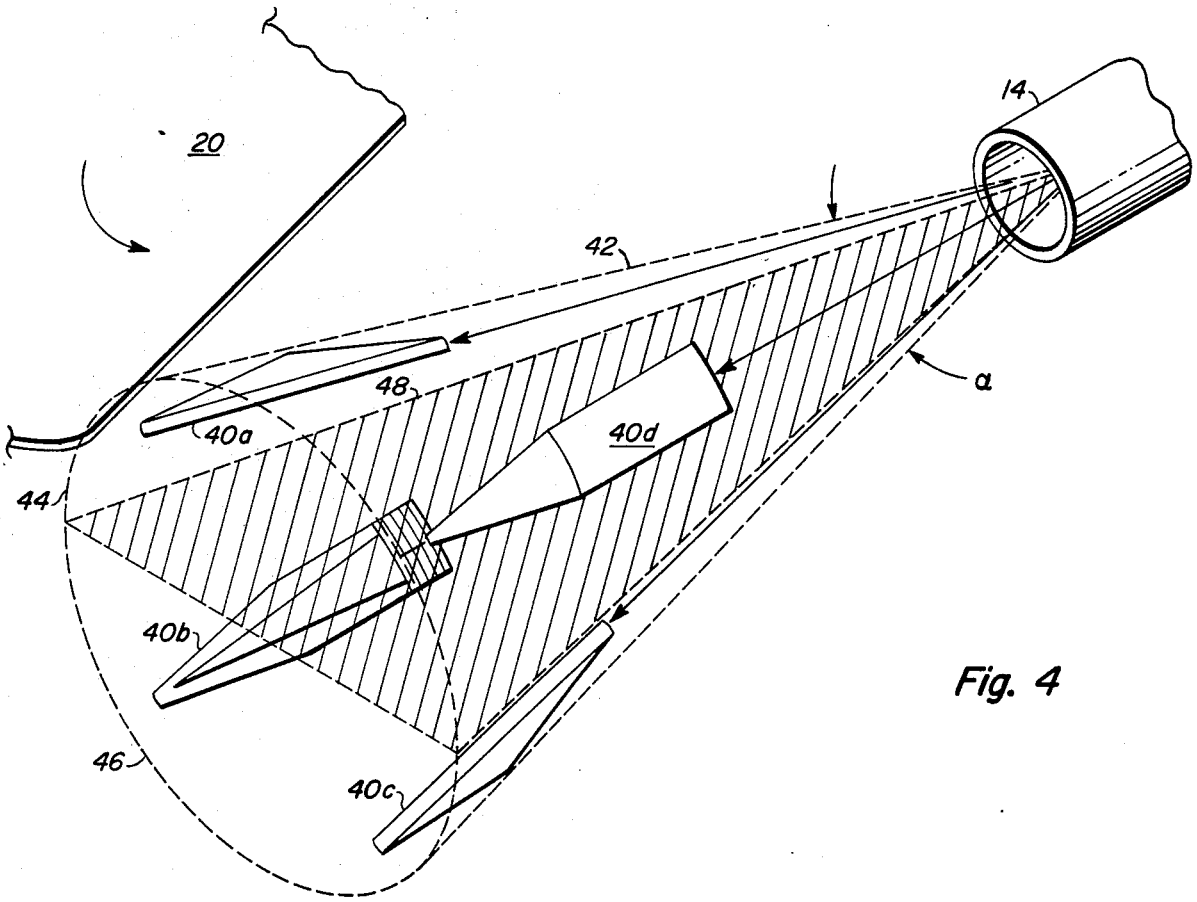
FIG. 4 demonstrates typical sabot fragment trajectories for the projectile of FIGS. 2 and 3.
Figure 5:
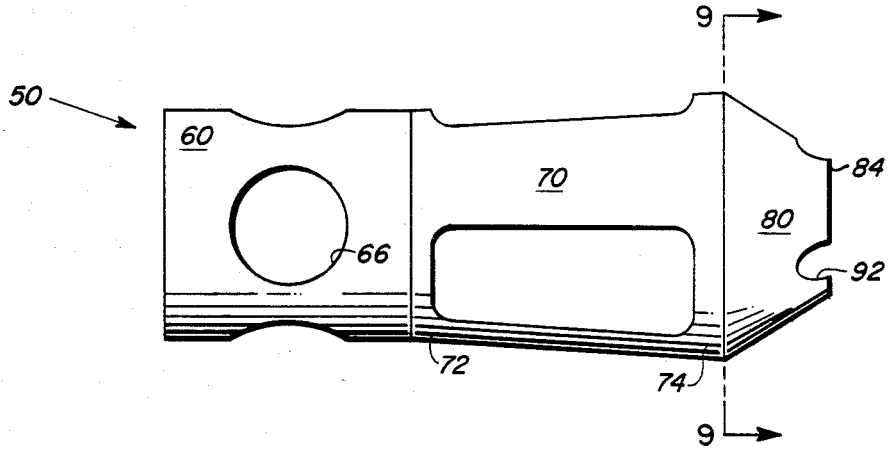
FIG. 5 is a side elevation view of the sabot diverter of the present invention.
Figure 6:
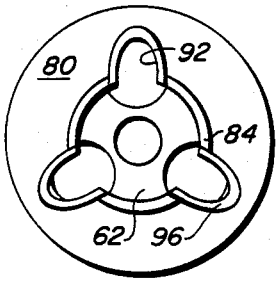
FIG. 6 is an end view of the sabot diverter of FIG. 5.

Illustrated in FIG. 1 is a rotary wing aircraft 10 engaged in a combat situation. Aircraft 10 has a tracking gun system 12 which directs one or more gun barrels 14 to shoot projectiles in a trajectory so as to impact target 16. Gun barrel elevation is limited by an angle $\alpha$ which defines the area in which high-speed discarded sabot fragments can be encountered. Angle $\alpha$ is thus a limiting angle and is a function of aircraft attitude with respect to the target. Ideally the barrels of a gun system should be trainable to design limits for maximum effectiveness irrespective of the type of ammunition utilized in that gun system. Heretofore the use of discarding sabot projectiles has in some cases necessitated the use of lockout techniques to limit gun barrel train and elevation to less than design limits under certain circumstances of target engagement for fear of direct high speed sabot fragment impact with the firing platform. In the illustrated application impact with rotary wing 20 of aircraft is to be avoided. It is noted at the outset that while the apparatus of the present invention is described in the context of helicopter usage, the apparatus would be equally useful in any application where discarding sabot projectiles are utilized and impact of sabot fragments with the firing platform is possible and undesirable or where the directionally controlled deflection of sabot fragments is for some other reason advantageous.

Referring to FIGS. 2 and 3 it can be seen that discarding sabot projectiles 30 include a metallic pusher 32, an armor piercing penetrator 34 and a sabor 36. Sabot 36 fragments and separates from pusher 32 and penetrator 34 immediately after projectile 30 leaves the barrel of the gun from which fired.

The separation and fragmentation of sabot 36 from pusher 32 and penetrator 34 is designed to occur in a controlled manner along predetermined weakened axis 38 and results from the forces and dynamics of projectile firing. Two or more sabot fragments, called petals in the trade, result from the firing of a discarding sabot projectile. The projectile demonstrated in FIGS. 2 and 3 includes a sabot designed to separate into four separate fragments or petals, 40*a*, 40*b*, 40*c* and 40*d*.

After projectile firing, penetrator 34 and pusher 32 are propelled at high speeds directly along the axis of the gun barrel from which fired. Due to the firing velocities involved, the separation of pusher 32 from penetrator 34 and decay of the trajectory of penetrator 34 due to gravitational forces have no physical effect on the firing platform in that these events occur at a safe distance from the firing platform. FIG. 4 however, demonstrates that sabot fragments 40*a*, 40*b*, 40*c* and 40*d* can be encountered anywhere in cone 42 which has its apex at a point just inside the firing gun barrel and which is defined by an angle $\alpha$. Angle $\alpha$ has been demonstrated to be generally an angle of 14° in certain helicopter gunship configurations. Thus 7° approximates the degree to which gun barrel elevation must be limited below design elevation absent the elimination of sabot fragments in certain portions of cone 42. Cone 42 in FIG. 4 has been divided into upper section 44 and lower section 46 by plane 48 which if extended would horizontally bisect firing gun barrel 14. Although sabot fragment trajectories vary, it can be seen that only those fragments traveling in upper section 44 are of any concern with respect to the possibility of impact with rotary wing 20 if their trajectory remains unaltered. FIG. 4 demonstrates that if the flight of sabot fragments in upper section 44 of cone 42 is eliminated gun barrel 14 can be elevated to design limits.

FIGS. 5, 6, 7 and 8 demonstrate the preferred embodiment of the sabot diverter of the present invention.

Fragment diverter 50 includes mounting sleeve 60 which is preferably and most conveniently a hollow closed end right circular cylinder having an apertured front plate 62 and an apertured back plate 64. Front plate 62 and a back plate 64 include aligned apertures through which gun barrels 14 extend and may include lightening holes 66 to lessen the weight of fragment diverter 50 and decrease the aerodynamic drag on the gun system. Front plate 62 may include an additional aperture to accommodate the fixed attachment of diverter 50 to gun barrels 14 by means of the retaining arrangement shown generally at 68 in FIG. 7. It is noted that diverter 50 may be attached to gun barrels 14 in many ways well known in the art such as welding, clipping, threaded engagement or bayonet type mounting. The arrangement shown in FIG. 7 is but one of many possible diverter mounting schemes and is one which has proven to be both simple and convenient.

Extender cage 70 is illustrated as a hollow open ended frustrum having a neck portion 72 and a base portion 74. The diameter of neck portion 72 is less than the diameter of base portion 74. Extender cage 70 is fixedly attached at neck portion 72 to mounting sleeve 60. As shown, extender cage 70 includes lightening holes 76 which, like those in mounting sleeve 60 decrease the weight of the gun system and the aerodynamic drag on the system attributable to diverter 50. Extender cage 70 defines an expansion chamber 78, through which all components of a fired discarding sabot projectile will pass unimpeded. The geometry of extender cage 70 is not critical as its essential purpose is to provide an attachment point for the portion of the apparatus of the present invention which performs the critical sabot diverting function. As such, extender cages of many geometries can readily be envisioned, the most obvious alternative being that of a right circular cylinder.

Deflector section 80 of diverter 50 is preferably an open ended hollow frustrum having a base portion 82, a neck portion 84, and a wall 86. The diameter of base portion 82 is greater than the diameter of neck portion 84. Deflector section 80 is fixedly attached at base portion 82 to extender cage 70 and defines fragment control chamber 88. The interior face of wall 86 forms a sabot fragment deflecting face 90 for altering the trajectory, by deflection, of any sabot fragment which impacts it. One cutout 92 is defined by wall 86 for each gun barrel of the gun system to which diverter 50 is attached. Each cutout 92 is aligned and associated with one gun barrel of the gun system and provides an egress through deflector section 80 having a cross-sectional area large enough to ensure that the penetrator portions of projectiles fired from the associated gun barrel pass through deflector section 80 unimpeded after discarding its sabot. The dimensions of cutouts 92 are a function of the caliber of the gun system and the conventional ammunition projectiles which diverter 50 must accommodate.

Figure 7:
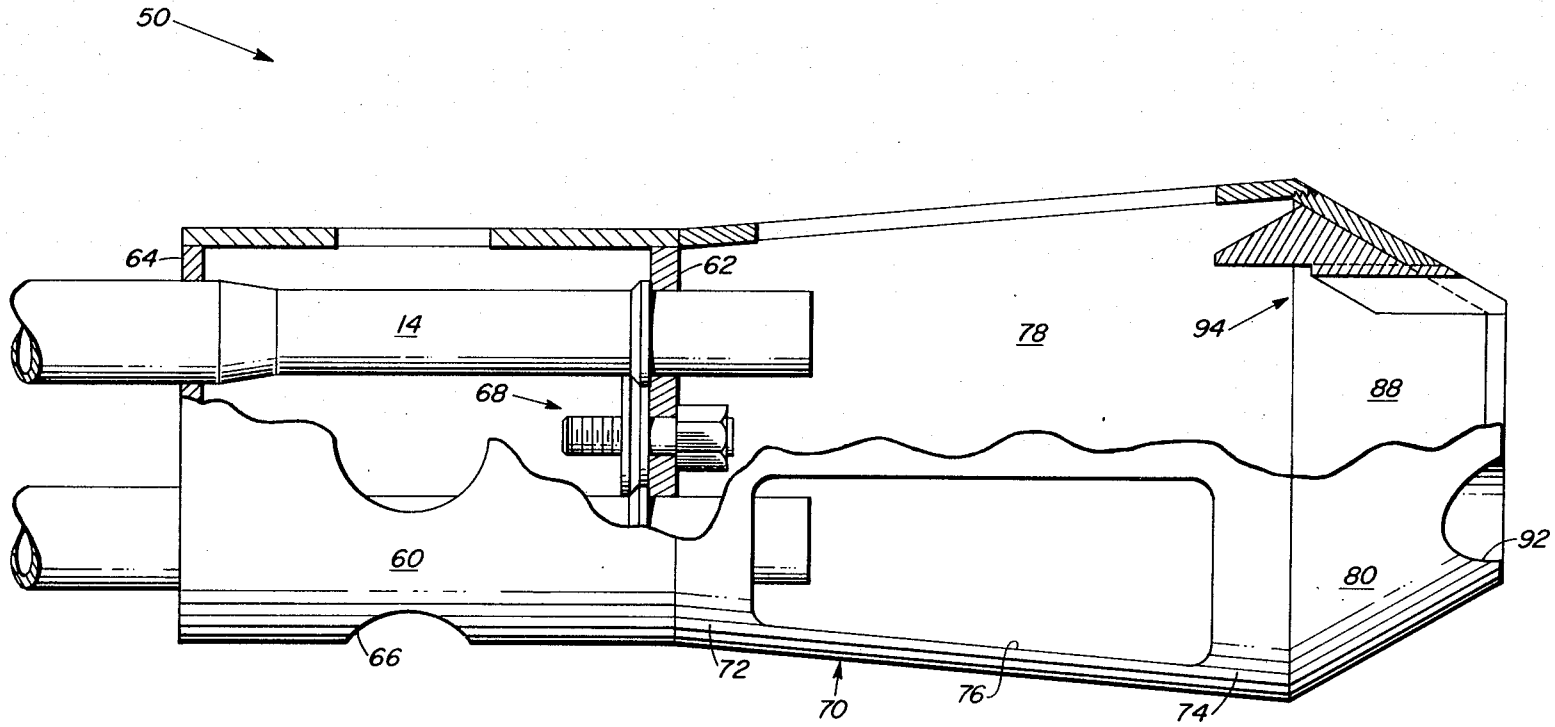
FIG. 7 is a cutaway section view of the sabot diverter of FIG. 5 as installed on a rotating barrel gun system exposing the cutter and diverter apparatus.

Referring now to FIGS. 7, 8 and 9 independently extending around the perimeter of cutout 92 into fragment control chamber 88 is cutter-dam 94. Cutter-dam 94 can be attached to deflector section 80 in many ways well known in the art, the most obvious being some form of welding or brazing. Cutter-dam 94, which is preferably fabricated from a high carbon steel material, includes two essential portions, a horse collar and a blade, each of which has an independent but related function. Horse collar portion 96 is a raised wall which extends into fragment control chamber 88 around the perimeter of cutout 92 and which includes an outer deflecting face 98. Horse collar portion 96 presents a physical barrier to prevent any fragment deflected by deflecting face 90 from entering the line of fire of the gun barrel from which it was fired. Any fragment impacting outer face 98 of horse collar portion 96 after being deflected by deflecting surface 90 will be further deflected so as to exit diverter 50 with a trajectory not allowing for its entry of the line of fire of the gun barrel from which it has exited. Blade 100 of cutter-dam 94 is attached to deflecting face 90 and extends into fragment control chamber 88 toward mounting sleeve 60 farther than horse collar 96. Cutter-dam 94 is mounted in deflector section 80 such that blade 100 lies in a plane which bisects both cutout 92 and the gun barrel with which cutout 92 is aligned.

The essential structure of fragment diverter 50 which includes mounting sleeve 60 and extender cage 70 should be fabricated of a light, rigid and heat resistant material. Titanium is the preferred material of use although steel is an adequate though less desirable material from a weight standpoint. Deflector section 80, which includes cutter-dam 94 and its components, will absorb the direct impact of high speed sabot fragments and after extensive use blade 100 may be found to be broken or worn as might horse collar portion 96. It is thus advantageous to attach deflector section 80 to the remainder of fragment diverter 50 in a manner allowing for its expedient replacement. FIG. 8 demonstrates the threaded attachment of diverter section 80 at base portion 82 to base portion 74 of extender cage 70. Several means for attachment allowing for the expedient replacement of diverter section 80 in fragment diverter 50 are envisioned in addition to the threadable attachment demonstrated in FIG. 8. These methods include, but are not limited to, the use of locking rings, clips of various types and retainer collars. The only constraint noted in relation to the attachment of diverter section 80 to fragment diverter 50 is that cutout 92 must align with and remain aligned with its associated gun barrel after diverter section 80 is attached to extender cage 70 of diverter 50.

Referring now to FIGS. 8 and 9 in operation, sabot fragments 40*a*, 40*b*, 40*c* and 40*d* separate from their pusher 32 and penetrator 34 after exiting a gun barrel. Fragments 40*b* and 40*c* are shown to have trajectories which will not result in their impact with the firing platform. Fragment diverter 50 does not interfere with the travel of these fragments which are allowed to continue uninterrupted on a natural trajectory. Sabot fragments 40*a* and 40*d* however are demonstrated to have trajectories which, if uninterrupted, could lead to their direct impact with the firing platform. Due to this possibility the flight of fragments 40*a* and 40*d* is intercepted by diverter section 80 at impact points 22. The impact of fragments 40*a* and 40*d* with deflecting surface 90 of deflector section 80 results in a new trajectory for those fragments such that no direct impact with the firing platform can occur. The exact point of impact of sabot fragments on deflecting face 90 is not predictable and differs with each round fired although possible impact points 22 are indicated in FIGS. 9 and 10.

Referring now to FIG. 10 the function of cutter-dam 94 is demonstrated. Fragment 40*a* is shown having a trajectory in which impact with blade 100 of cutter-dam 94 occurs. It can be seen that if cutter-dam 94 did not exist in diverter section 80 fragment 40*a* would be deflected directly into the line of fire of the gun barrel from which it issued. Deflection of fragments into the line of fire of a gun barrel is to be avoided due to the possibility of fragment impact with the penetrator from which it has separated. Such an impact could conceivably result in an undesirable alteration of the trajectory of the penetrator. Cutter-dam 94 prevents any sabot fragment deflected by deflecting face 90 from entering the line of fire of a gun barrel. Any fragment impacting blade 100 is broken into smaller fragments each of which has an altered trajectory which will result in its impact with deflecting face 90 on one side or the other of blade 100. These resulting fragments impact deflecting face 90 and are redeflected directly out of diverter 50 or are redeflected into outer face 98 of horse collar portion 96 where their trajectories are further altered to result in their harmless exit from diverter 50. Due to the angle of sabot fragment separation from the penetrator and pusher no direct impact of a fragment with horse collar portion 96 should occur.

Described above is a sabot diverter fixedly attached for rotation with the barrels of a helicopter mounted rotating three barrel tracking gun system in which only the barrel rotated into the upper position is fired. FIGS. 9 and 10 demonstrate that in the embodiment above described a cutter-dam is provided for each barrel and is positioned to perform its diverting function when the associated barrel is rotated into the firing position. It is clear from the accompanying drawings and the description provided above that embodiments of sabot diverters for use with rotating or nonrotating gun systems having a single gun barrel or multiple gun barrels of a number other than three would not be significantly different and could be fashioned by one of nominal skill in the art utilizing the embodiment described and illustrated. Depending upon gun system characteristics, ammunition characteristics, and the characteristics of the firing platform, adjustments might be required with respect to diverter attachment to the gun system and/or cutter-dam orientation with respect to a gun barrel.

Other readily apparent modifications and improvements may be made as well without departing from the scope and spirit of the invention as described. Accordingly the invention is not to be limited by the illustrative embodiment but only by the scope of the appended claims.

What is claimed is:

1. A fragment diverter for attachment to the muzzle end of a platform carried gun system having at least one firing gun barrel, for altering, in a directionally controlled manner, the trajectory of selected sabot fragments discarded from fired discarding sabot type projectiles, which comprises:

a mounting section, said mounting section configured for rigid attachment to said muzzle end of said gun system;

an extender cage, said extender cage attached to said mounting section and defining an expansion chamber through which all components of said discarding sabot projectiles, including said discarded sabot fragments, travel unimpeded;

a deflector section, said deflector section being a hollow, open ended frustrum defining a fragment control chamber, said deflector section having a base portion, a neck portion and a wall, said base portion of said deflector section attached to said extender cage and one face of said deflector section wall forming a fragment deflecting surface, said deflector section wall defining a cutout opening into said neck portion of said deflector section, said cutout aligned with said gun barrel from which said discarding sabot type projectiles are fired, said deflecting surface being for the purpose of intercepting and altering the trajectory of a selected portion of said separated sabot fragments, said selected portion of separated fragments being those fragments having trajectories which if unaltered would result in direct fragment impact with said firing platform; and a cutter-dam, said cutter-dam mounted in said deflector section to split directly impacting fragments for further interaction with said deflecting surface and to prevent said sabot fragments having trajectories altered by said deflecting surface from entering the line of fire of said firing gun barrel of said gun system.

2. A fragment diverter according to claim 1 wherein said cutter-dam includes a horse collar portion and a blade portion, said horse collar portion being a raised wall attached to and extending around the perimeter of said cutout and into said fragment control chamber of said deflector section, said blade portion attached to said horse collar portion and said fragment deflecting surface of said deflector section and said blade portion extending into said fragment control chamber farther than said horse collar portion extends into said fragment control chamber, said blade portion mounted in a plane which bisects both said deflector section cutout and said projectile firing gun barrel.

3. A fragment diverter according to claim 2 wherein said extender cage is a hollow open-ended frustrum defining a plurality of lightening holes, said extender cage having a base portion and a neck portion, said base portion of said extender cage attached to said base portion of said deflector section and said neck portion of said extender cage attached to said mounting section.

4. A fragment diverter according to claim 1 wherein said deflector section is replaceable when worn and said fragment diverter includes means for attaching said deflector section to said extender cage for facilitating the replacement of said deflector section of an expedient manner.

5. A fragment diverter according to claim 2 wherein said deflector section is replaceable when worn and said fragment diverter includes means for attaching said deflector section to said extender cage for facilitating the replacement of said diverter cone in an expedient manner.

6. A fragment diverter according to claim 5 wherein said deflector section is threadably attached to said extender cage.

* * * * *